US007621432B2

(12) United States Patent
Chiang et al.

(10) Patent No.: US 7,621,432 B2
(45) Date of Patent: Nov. 24, 2009

(54) STAPLER

(75) Inventors: Chun-Hsien Chiang, Chang Hua (TW); I-Hui Liu, Changhua Hsien (TW)

(73) Assignee: SDI Corporation (TW)

( * ) Notice: Subject to any disclaimer, the term of this patent is extended or adjusted under 35 U.S.C. 154(b) by 0 days.

(21) Appl. No.: 11/893,694

(22) Filed: Aug. 17, 2007

(65) Prior Publication Data

US 2009/0045240 A1 Feb. 19, 2009

(51) Int. Cl.
*B25C 5/02* (2006.01)

(52) U.S. Cl. ..... 227/120; 227/132; 227/134; 227/109; 227/128

(58) Field of Classification Search ..... 227/120, 227/132, 134, 109, 128
See application file for complete search history.

(56) References Cited

U.S. PATENT DOCUMENTS 2,227,314 A * 12/1940 Maynard ..... 227/120
4,491,261 A * 1/1985 Mitsuhashi ..... 227/76
4,732,309 A * 3/1988 Judge ..... 227/109
5,979,734 A * 11/1999 Chang ..... 227/76
6,527,157 B1 * 3/2003 Choi ..... 227/76
6,550,661 B2 * 4/2003 Aoki ..... 227/134
6,966,479 B2 * 11/2005 Tanaka et al. ..... 227/144
7,322,504 B2 * 1/2008 Chen ..... 227/129
7,431,186 B2 * 10/2008 Hsu ..... 227/120
2007/0221699 A1 * 9/2007 Hsu ..... 227/134

* cited by examiner

*Primary Examiner*—Rinaldi I. Rada
*Assistant Examiner*—Michelle Lopez
(74) *Attorney, Agent, or Firm*—Frenkel & Associates, P.C.

(57) ABSTRACT

A stapler has a center of gravity and has a base assembly, a magazine assembly and a trigger assembly. The magazine assembly connects to the base assembly and has a cap. The trigger assembly connects to the base assembly and has a trigger lever and a limiting lever. The limiting lever prevents the trigger lever and the cap from pivoting excessively to keep the center of gravity of the stapler over the base assembly so that refilling the stapler is convenient.

6 Claims, 8 Drawing Sheets

STAPLER

BACKGROUND OF THE INVENTION

1. Field of the Invention

The present invention relates to a stapler, and more particularly to a stapler that is labor saving and will not turn over when the stapler is opened to install staples.

2. Description of Related Art

Staplers are common in offices and are used to connect separate documents or sheets of paper together. A large percentage of workers stapling documents are female and may not have the strength required for continuous heavy stapling. When stapling documents, office workers must forcefully push the lever of the stapler to make the staple penetrate the sheets of paper or a document. After hundreds of times of stapling day after day, the workers experience aches and pains on the palms or in the fingers. Therefore, a laborsaving stapler has been developed and has a base, a magazine, a trigger assembly and an articulated assembly. The articulated assembly allows a user to staple paper sheets with less effort when compared to a traditional stapler. However, the laborsaving stapler has a complicated structure and therefore has a high cost.

Moreover, inserting staples into the magazine of the laborsaving or traditional stapler requires pivoting the trigger assembly away from the magazine, which causes the laborsaving or traditional stapler to fall over.

To overcome the shortcomings, the present invention provides a stapler to mitigate or obviate the aforementioned problems.

SUMMARY OF THE INVENTION

The main objective of the invention is to provide a stapler that is laborsaving and will not fall over when the stapler is opened to load staples in the stapler.

A stapler in accordance with the present invention has a center of gravity and comprises a base assembly, a magazine assembly and a trigger assembly. The magazine assembly connects to the base assembly and has a cap. The trigger assembly connects to the base assembly and has a trigger lever and a limiting lever. The limiting lever prevents the trigger lever and the cap from pivoting excessively to keep the center of gravity of the staple over the base assembly.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
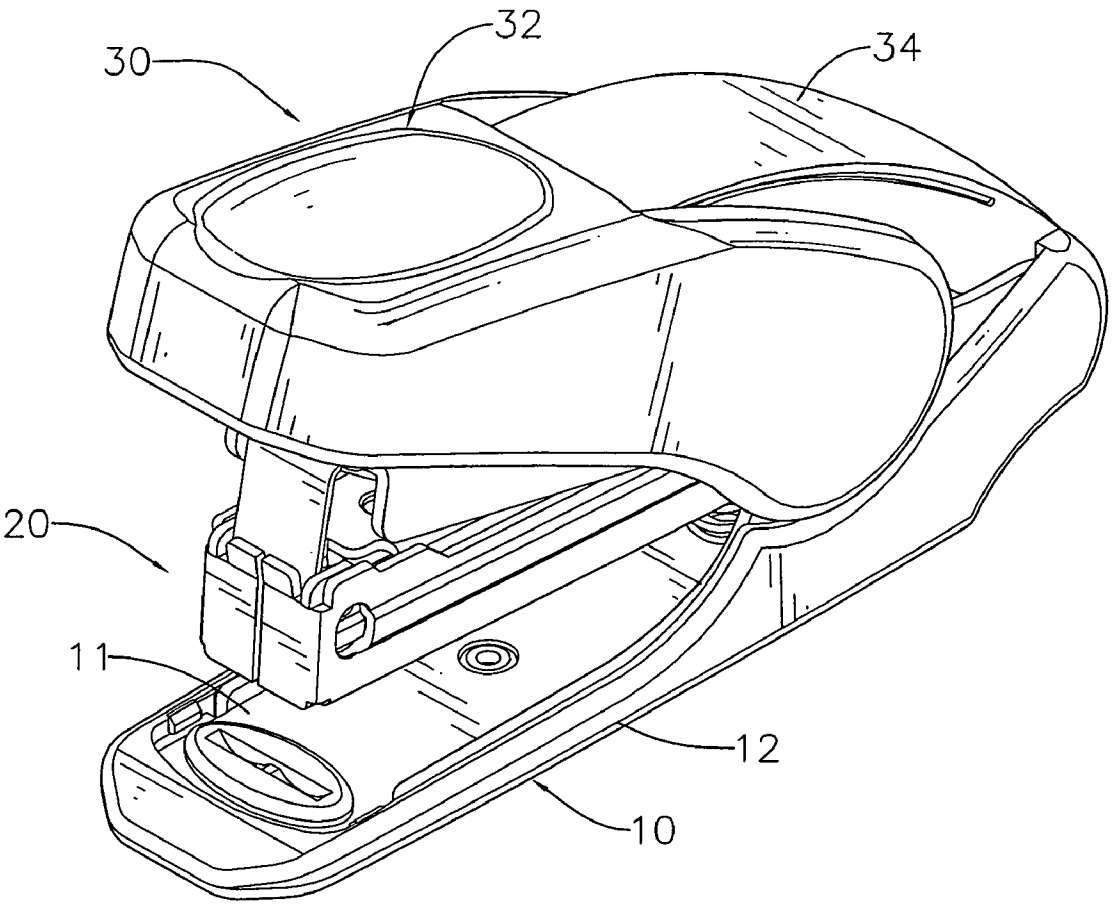
FIG. 1 is a perspective view of a stapler in accordance with the present invention.
Figure 2:
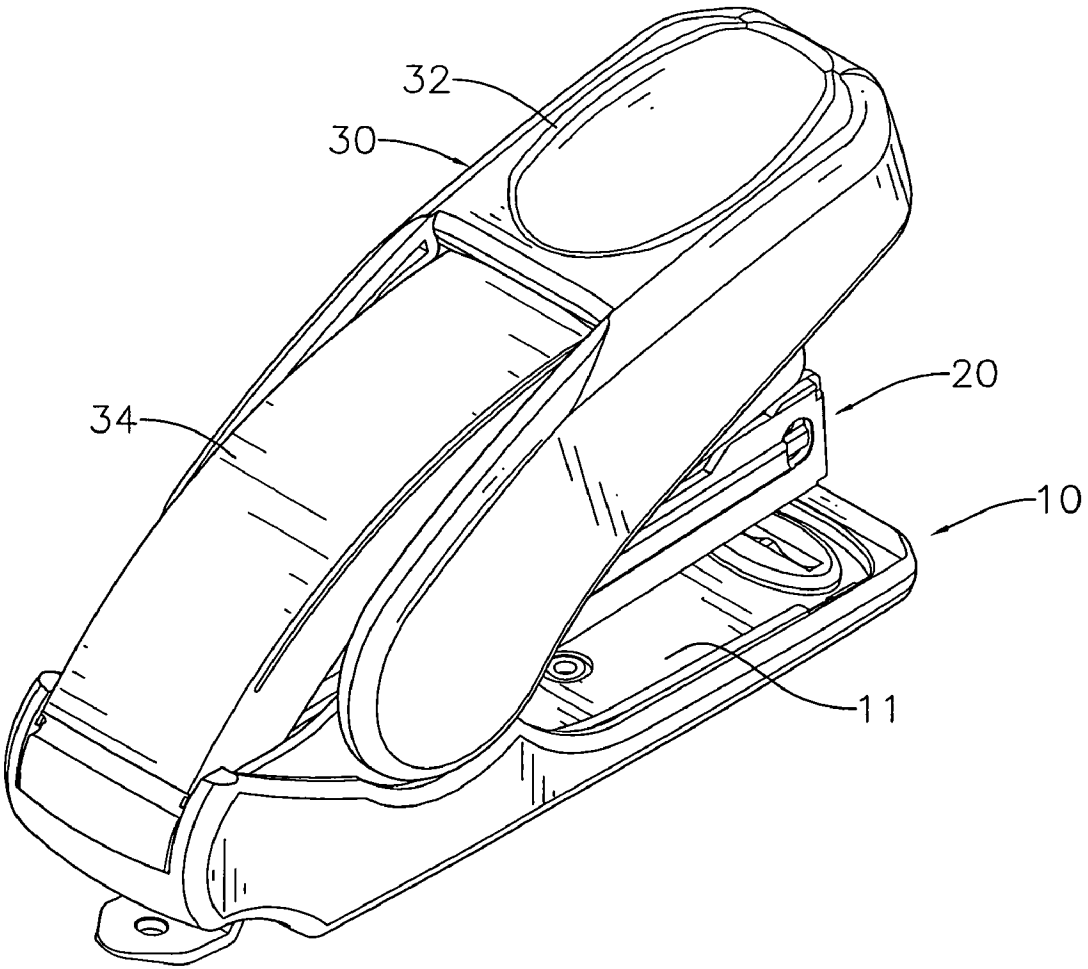
FIG. 2 is another perspective view of the stapler in FIG. 1.

With reference to FIGS. 1 and 2, a stapler in accordance with the present invention has a center of gravity and comprises a base assembly (10), a magazine assembly (20) and a trigger assembly (30). The center of gravity of the stapler depends of the operational configuration of the stapler.

Figure 3:
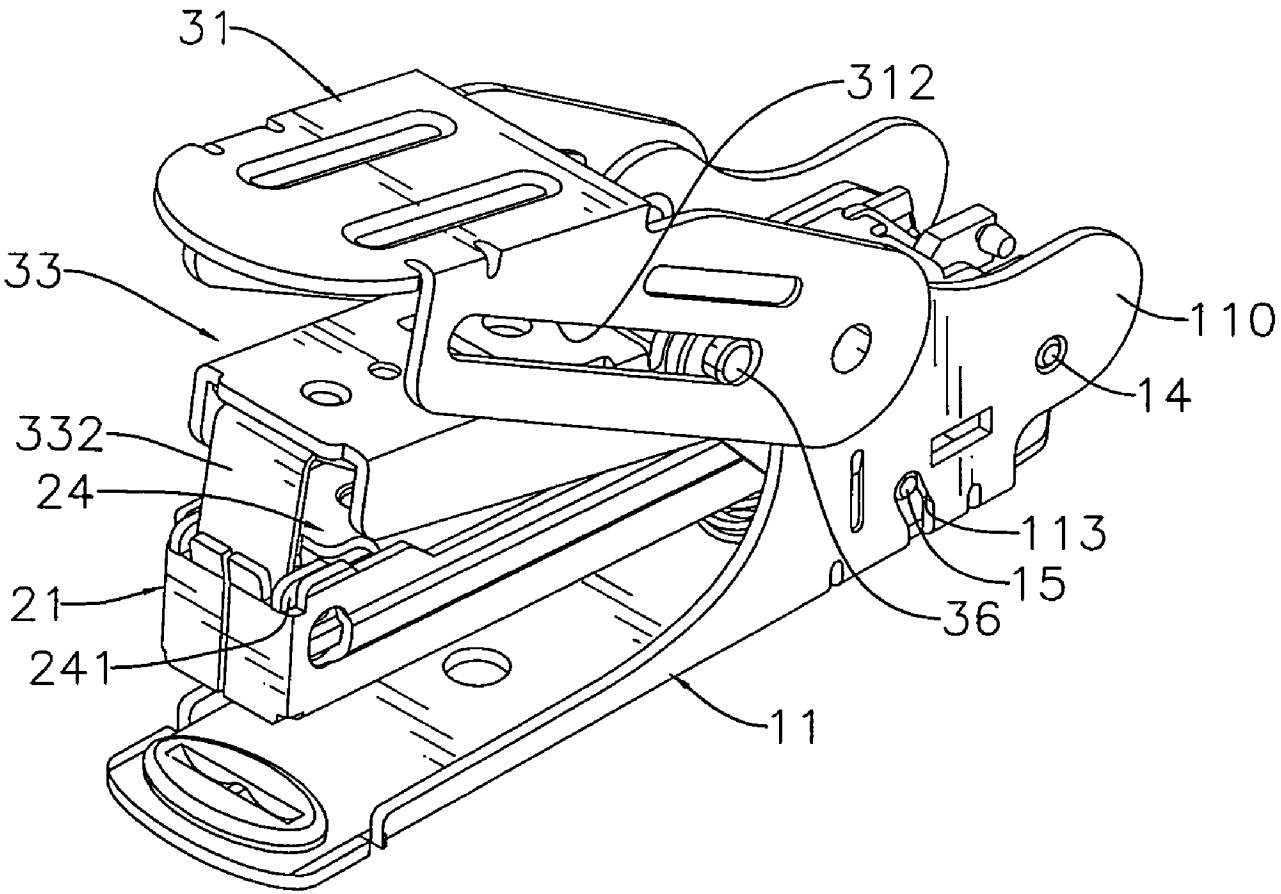
FIG. 3 is a perspective view of the stapler with in FIG. 1 with top and bottom covers removed.
Figure 4:
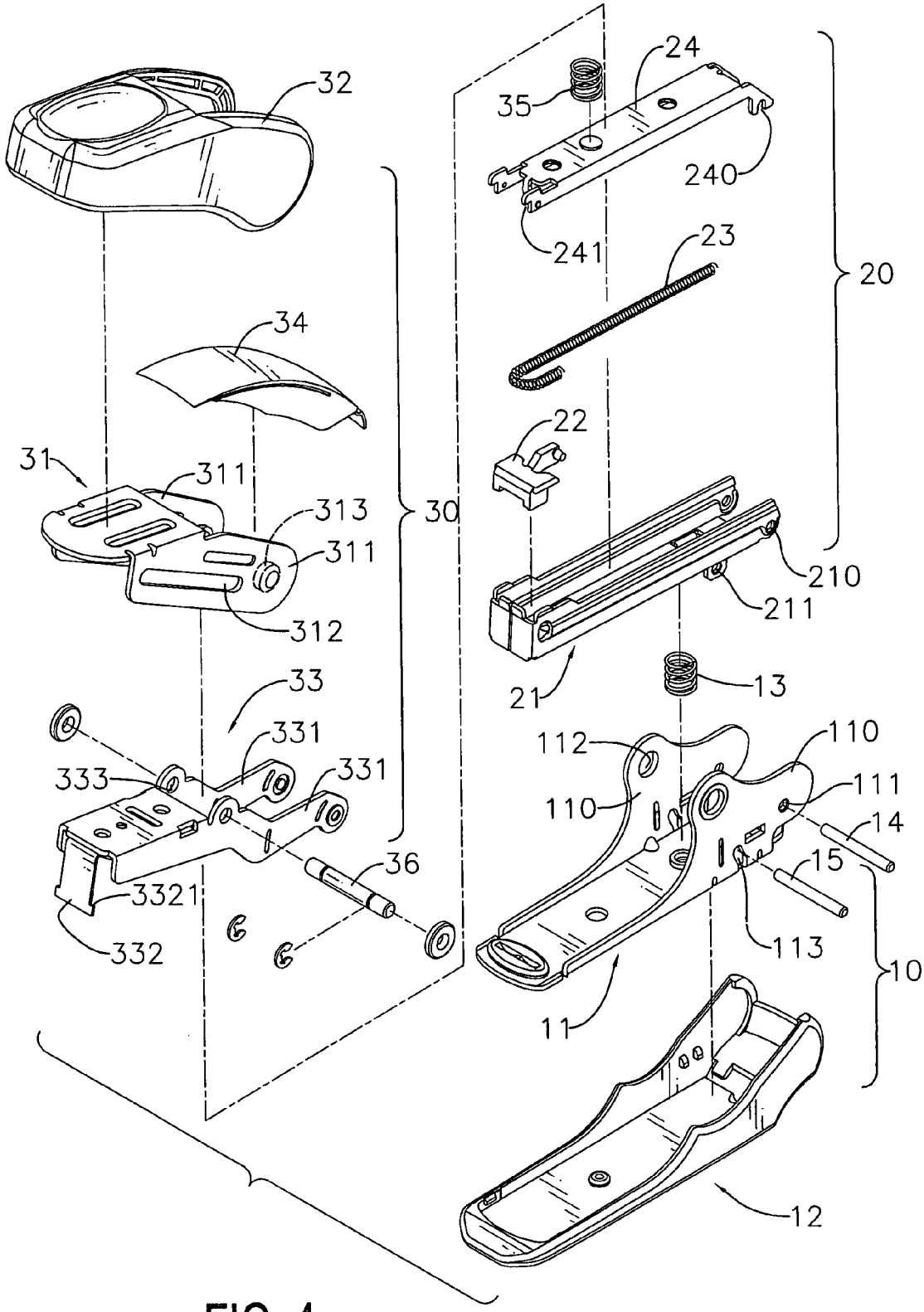
FIG. 4 is an exploded perspective view of the stapler in FIG. 1.

With further reference to FIGS. 3 and 4, the base assembly (10) has a base (11) and may further have a bottom spring (13), a rear pintle (14), a slide pintle (15) and a bottom cover (12).

The base (11) has a front end, a rear end, a bottom bar and two wings (110). The bottom bar has two opposite sides. The wings (110) protrude up from the sides of the bottom bar near the rear end. Each wing (110) may have a rear pivot hole (111), a front pivot hole (112), a curved slot (113) and a straight slot (114). The front pivot hole (112) is in front of and above the rear pivot hole (111). The curved slot (113) is an arc of a circle, is defined through the wing (110) and is concentric with the rear pivot hole (111) serving as a center of the circle. The straight slot (114) is defined through the wing (110) and communicates with the curved slot (113).

The bottom spring (13) is mounted on the bottom bar of the base (11).

The rear pintle (14) is mounted through the rear pivot holes (111) in the wings (110).

The slide pintle (15) is mounted through the curved slots (113) and is capable of sliding along the curved slot (113).

The bottom cover (12) is mounted under and covers the base (11).

Figure 5:
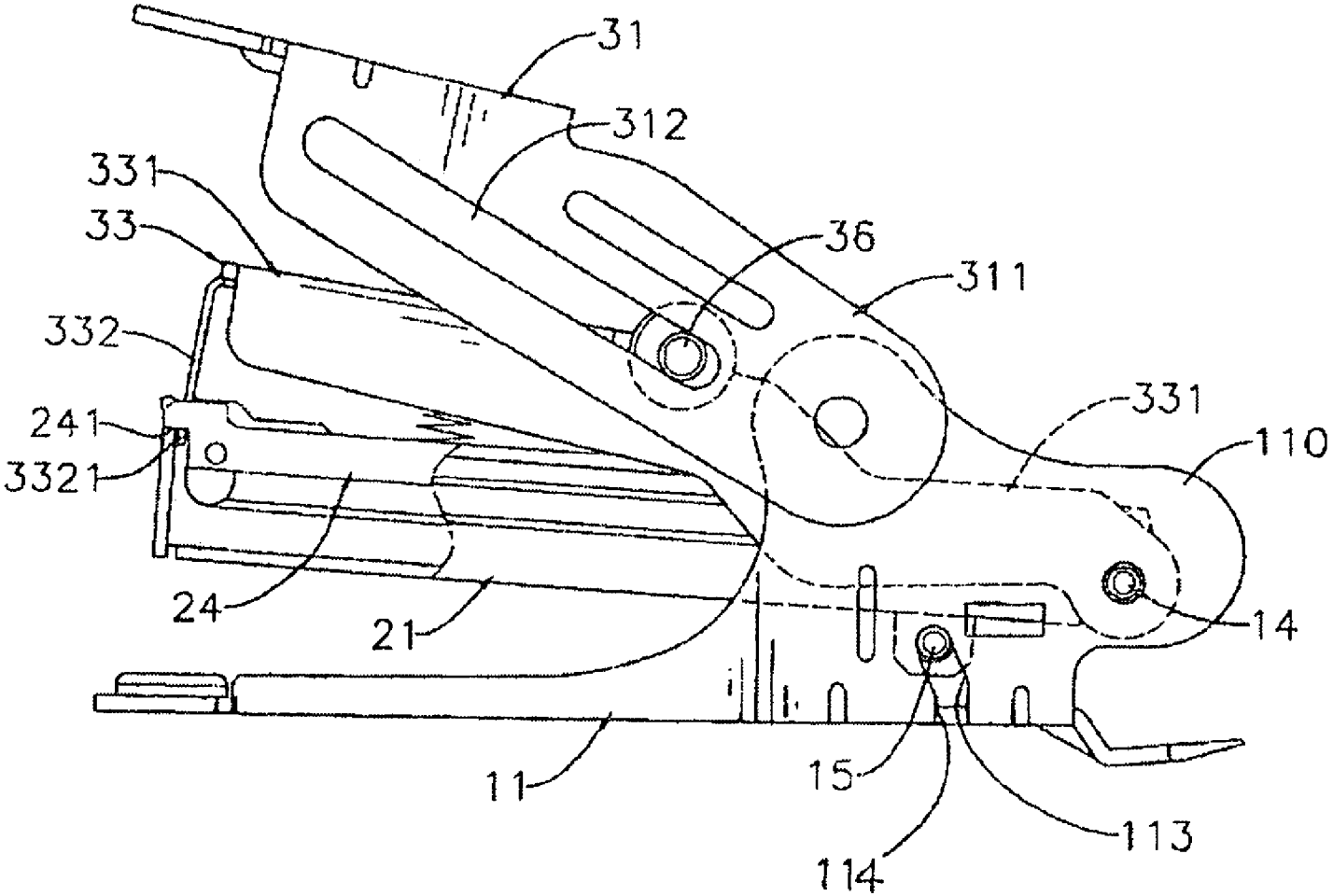
FIG. 5 is a side view of the stapler in FIG. 3.

With further reference to FIG. 5, the magazine assembly (20) connects pivotally to the base assembly (10) and has a magazine (21) and a cap (24) and may further have a staple foot (22) and a compression spring (23).

The magazine (21) connects pivotally to the base (11), is connected slidably to the base (11) at a first position on the base (11), may press against the bottom spring (13) and has a front end, a rear connecting end and a cavity and may further have a pintle mount. The rear connecting end connects pivotally to and between the wings (110) adjacent to the rear end of the base (11) and may have a pintle hole (210) through which the rear pintle (14) is mounted. The cavity is defined in the magazine (21) and holds staples. The pintle mount is formed on the magazine (21) near the rear connecting end and has a mounting hole (211) mounted around the slide pintle (15) to slidably connect the magazine (21) to the base (11) at the first position. The magazine (21) is held by the slide pintle (15) and is not able to pivot further up when the slide pintle (15) slides up to the end of the curved slots (113), so the first position on the base (11) provides a limiting effect to the magazine (21).

The cap (24) connects pivotally to the base (11), selectively covers the cavity in the magazine (21) and has a front end and a rear connecting end. The front end of the cap (24) may have two notches (241). The rear connecting end of the cap (24) connects pivotally to and between the wings (110) on the base (10) and may have a recess (240) engaging rotatably with the rear pintle (14).

The staple foot (22) is mounted slidably in the cavity and pushes staples toward the front end of the magazine (21).

The compression spring (23) is mounted in the cavity and biases the staple foot (22) against staples in the magazine (21).

The trigger assembly (30) connects pivotally to the base assembly (10), is pressed to staple paper sheets with staples in the magazine (21) and has a trigger lever (33), a limiting lever (31) and a slide pin (36) and may further have an internal spring (35), a top cover (32) and a gap cover (34).

The trigger lever (33) connects pivotally to the base (11) at a second position on the base (11), is located above the cap (24) and has a front end, a rear end, two opposite connecting tabs (331) and an activating tab (332). Additionally, the magazine (21) and the cap (24) are connected to the base (11) at the same second position on which the trigger lever (33) is pivotally connected. The connecting tabs (331) are formed on the trigger lever (33). Each connecting tab (331) has a front end, a rear connection end and an intermediate section. The rear connection end connects pivotally to one of the wings (110) on the base (10), and may have a pintle hole. The pintle hole is mounted around the rear pintle (14) to pivotally connect the trigger lever (33) to the base (11) at the second position. The intermediate section is between the front end and the rear connection end and has a pin hole (333). The activating tab (332) protrudes perpendicularly down from the front end of the trigger lever (33) and selectively extends through the front end of the magazine (21) to press a staple toward the bottom bar of the base (11). The activating tab (332) may have two opposite hooks (3321). The hooks (3321) are formed on the activating tab (332) and selectively engage the notches (241) in the cap (24) so pivoting the trigger lever (33) up also pivots the cap (24) up to open the magazine (21).

The limiting lever (31) connects pivotally to the base (11) at a third position on the base (11), is located above the trigger lever (33), selectively presses the trigger lever (33) down and has a front end, a rear end and two side tabs (311). The side tabs (311) are formed on the limiting lever (31), protrude from the rear end of the limiting lever (31) and form a gap. The gap is formed between the side tabs (311) at the rear end of the limiting lever (31). Each side tab (311) has a rear connection end and a limiting slot (312). The rear connection end connects pivotally to one of the wings (110), is located in front of and above the rear end of the trigger lever (33) and may have a pivot boss (313) protruding inward from the side tabs (311) and mounted rotatably in the front pivot hole (112) in the wing (110) to pivotally connect the limiting lever (31) to the base (11) at the third position. The limiting slot (312) is defined longitudinally through the side tab (311) and has a front end and a rear end. The first, second and third positions on the base connected respectively to the magazine (21), the trigger lever (33) and the limiting lever (31) are separated from each other but not arranged in a line.

Figure 6:
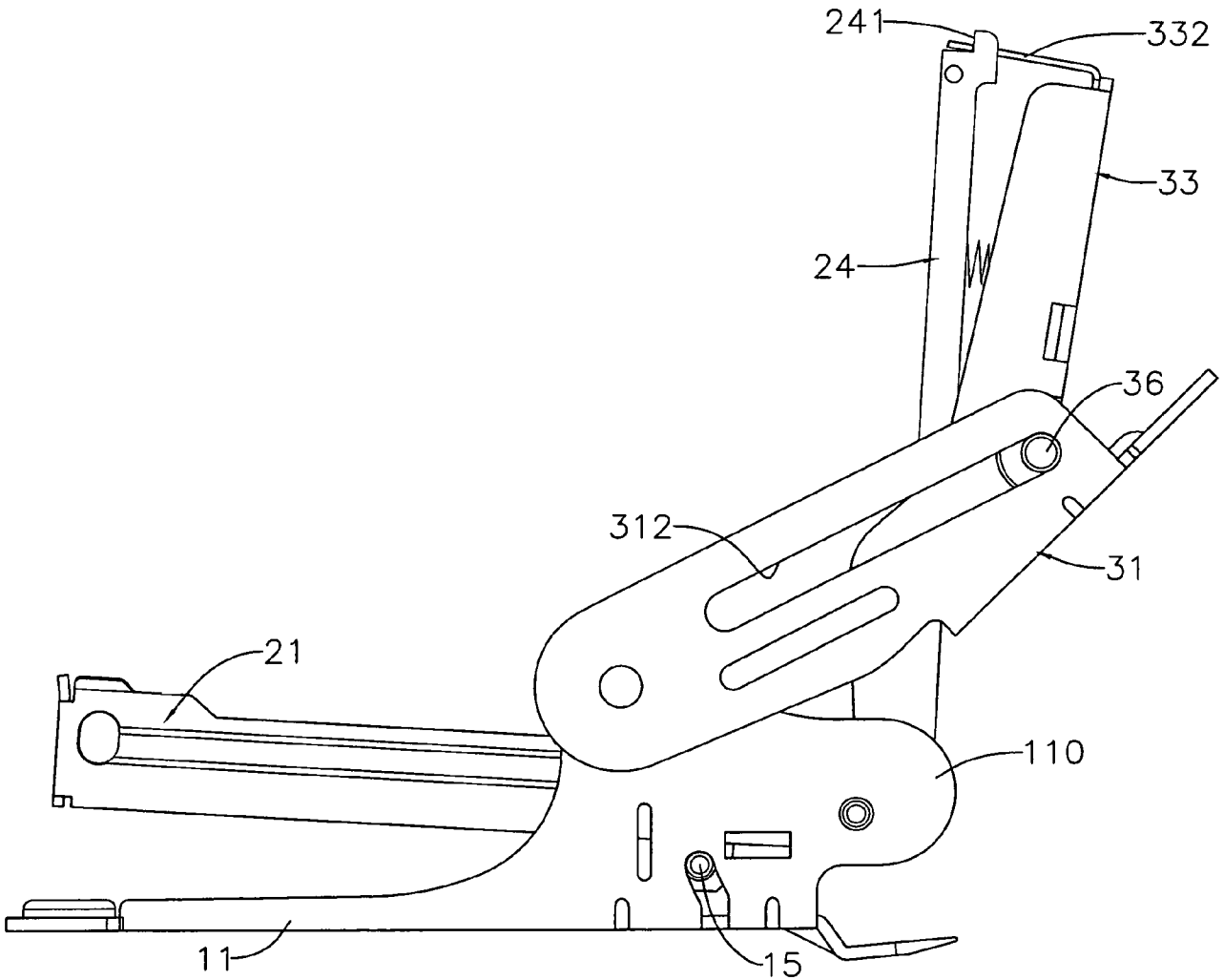
FIG. 6 is an operational side view of the stapler in FIG. 3 with the trigger assembly opened.

With reference to FIG. 6, the slide pin (36) extends through the pin holes (333) in the trigger lever (33) and the limiting slots (312) in the limiting lever (31) and slides in the limiting slots (312). When the trigger lever (33) and the cap (24) pivot up substantially perpendicular to the base (11), the slide pin (36) presses against the front ends of the limiting slots (312) and prevents the trigger lever (33) and the cap (24) from pivoting further away from the magazine (21) and the base (11). The cooperation of the slide pin (36) and the limiting slots (312) prevents the center of gravity of the stapler from over the base (11). Therefore, the opened stapler sitting on a table will not fall over so refilling the magazine (21) with staples is convenient.

The internal spring (35) is mounted between the cap (24) and the trigger lever (33).

The top cover (32) covers the limiting lever (31).

The gap cover (34) covers the gap in the limiting lever (31).

Figure 7:
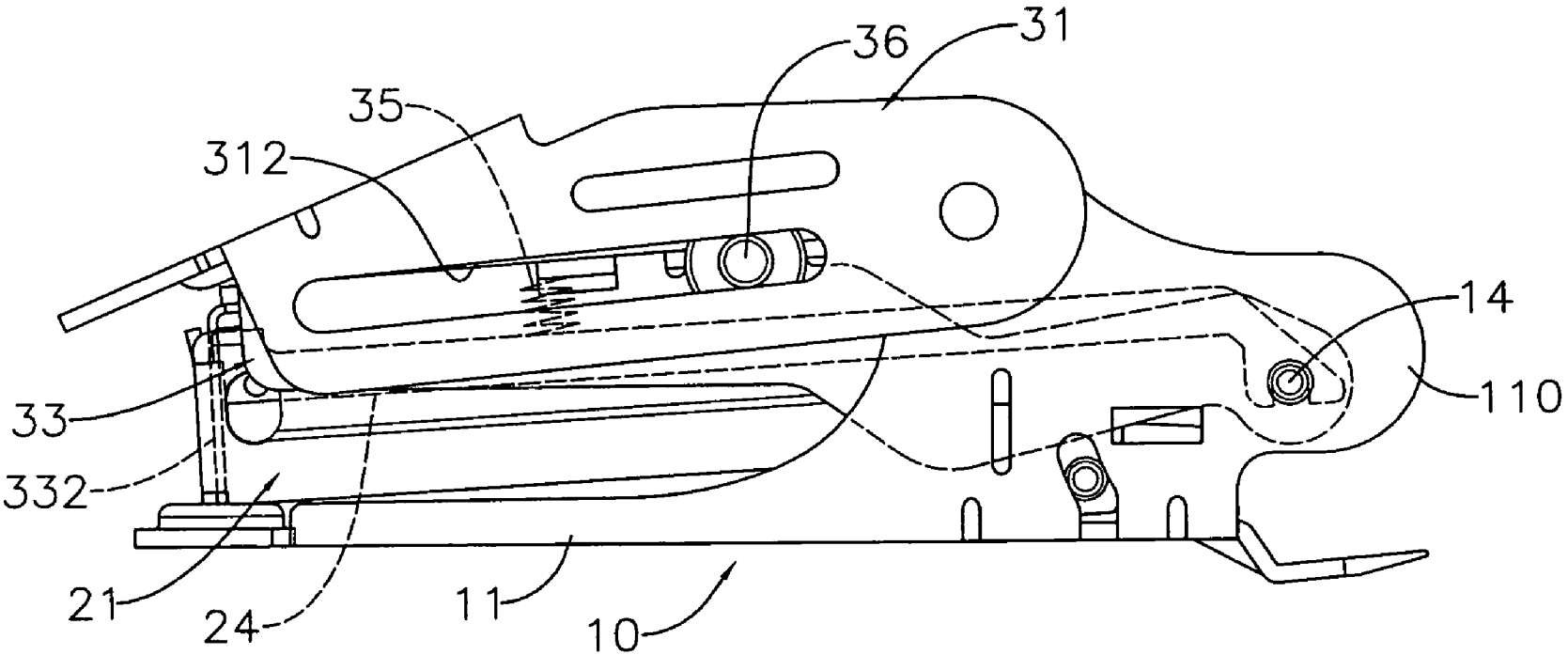
FIG. 7 is an operational side view of the stapler in FIG. 3 with the trigger assembly depressed to staple paper sheets.

With further reference to FIG. 7, the limiting lever (31) is pushed down to press against and depress the trigger lever (33) and cause the activating tab (332) to press a staple out of the magazine to staple paper sheets on the base (11).

Figure 8:
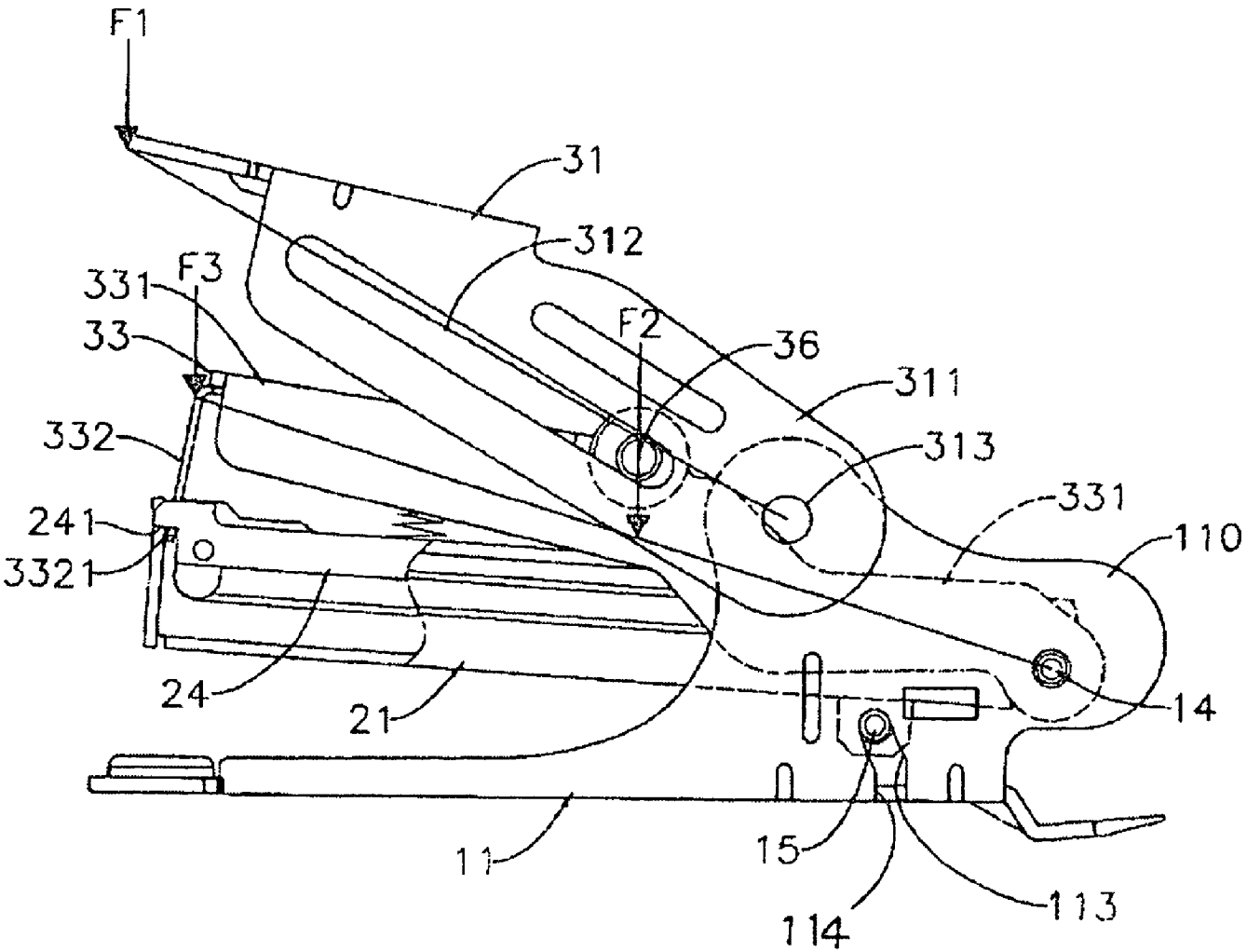
FIG. 8 is a side view of the stapler in FIG. 5 with force lines indicated.

With reference to FIG. 8, equations are used to prove that the stapler is laborsaving and is convenient to use. The equations include an input force ($F_1$) at the front end of the limiting lever (31), an internal force ($F_2$) applied at the slide pin (36) and an output force ($F_3$) applied at the front end of the trigger lever (33). A ratio of a length of the limiting lever (31) and a distance from the slide pin (36) to the pivot boss (313) is 5. A ratio of the length of the trigger lever (33) and a distance from the slide pin (36) to the rear pintle (14) is 2.

$$F_1 \times 5 = F_2 \times 1;\ F2 = 5F_1,;$$

$$F_3 \times 2 = F_2 \times 1;\ 2F_3 = 5F_1;$$

$$F_3 = 2.5F_1$$

Because the output force ($F_3$) is 2.5 times the input force ($F_2$), the stapler is laborsaving. Moreover, the limiting trigger (31) prevents the cap (24) and trigger lever (33) from pivoting excessively and keeps the center of gravity of the stapler over the base (11) so refilling the magazine is easy and convenient.

What is claimed is:

1. A stapler comprising a base assembly having a base having
- a front end;
- a rear end;
- a bottom bar having two opposite sides; and two wings protruding up from the sides of the bottom bar;

a magazine assembly connecting pivotally to the base assembly and having
- a magazine connecting pivotally to the base and having
  - a front end;
  - a rear connecting end connecting pivotally to and between the wings adjacent to the rear end of the base; and
  - a cavity defined in the magazine; and a trigger assembly connecting pivotally to the base assembly and having
- a trigger lever having
  - a front end;
  - a rear end;
  - two opposite connecting tabs formed on the trigger lever, and each connecting tab having
    - a front end;
    - a rear connection end connecting pivotally to one of the wings at a location adjacent to the rear end of the base; and
    - an intermediate section located between the front end and the rear connection end and having a pin hole; and
  - an activating tab protruding down from the front end of the trigger lever and selectively extending through the front end of the magazine;
- a limiting lever connecting pivotally to the base selectively pressing the trigger lever down and having
  - a front end;
  - a rear end; and
  - two side tabs, each side tab having
    - a front end;
    - a rear connection end connecting pivotally to one of the wings of said base in front of and above the location said trigger lever is connected pivotally to said wings;
    - an intermediate segment defined between the front end and the rear connection end of the side tab; and a limiting slot being defined longitudinally through the intermediate segment of the side tab and having a front end; and a rear end in front of said rear connection end of said limiting lever; and a slide element extending through the pin holes in the trigger lever and the limiting slots in the limiting lever, being capable of sliding along the limiting slots and selectively pressing against the front ends of the limiting slots to prevent the trigger lever from pivoting further away from the magazine and the base.

2. The stapler as claimed in claim 1, wherein each wing has a rear pivot hole;

a front pivot hole being in front of and above the rear pivot hole; and a curved slot being an arc of a circle, being defined through the wing and being concentric with the rear pivot hole serving as a center of the circle;

the base assembly further has a bottom spring mounted on the bottom bar of the base and pressing against the magazine;

a rear pintle mounted through the rear pivot holes; and a slide pintle mounted through the curved slots and being capable of sliding along the curved slot;

the rear connecting end of the magazine has a pintle hole through which the rear pintle is mounted;

the magazine further has a pintle mount formed on the magazine near the rear connecting end and having a mounting hole mounted around the slide pintle;

the rear connection end of each connecting tab of the trigger lever has a pintle hole mounted around the rear pintle; and each rear connection end of each side tab of the limiting lever has a pivot boss mounted rotatably in the front pivot hole in one of the wings.

3. The stapler as claimed in claim 2, wherein the magazine assembly further has a cap connecting pivotally to the base, selectively covering the cavity in the magazine and having a front end; and a rear connecting end connecting pivotally to and between the wings on the base.

4. The stapler as claimed in claim 3, wherein the front end of the cap further has two notches;

the activating tab has two opposite hooks formed on the activating tab and selectively engaging the notches in the cap; and the trigger assembly further has an internal spring mounted between the cap and the trigger lever.

5. The stapler as claimed in claim 4, wherein the base further has a bottom cover mounted under and covering the base; and the trigger assembly further has a gap formed between the side tabs of the limiting lever;

a top cover covering the limiting lever; and a gap cover covering the gap in the limiting lever.

6. The stapler as claimed in claim 3, wherein the rear connecting end of the magazine further has a recess engaging rotatably with the rear pintle.

* * * * *